United States Patent [19]

Tice et al.

[11] 4,135,322

[45] Jan. 23, 1979

[54] MUZZLE CHARGE STORAGE AND LOADING ACCESSORY FOR MUZZLE LOADING FIRE ARMS

[76] Inventors: Richard P. Tice, 3211 N. Nelson, Spokane, Wash. 99206; Donald L. Galbraith, 6205 N. Nevada, Spokane, Wash. 99207

[21] Appl. No.: 867,670

[22] Filed: Jan. 9, 1978

[51] Int. Cl.[2] ..... F42B 39/04; F41C 27/00

[52] U.S. Cl. ..... 42/90

[58] Field of Search ..... 42/90, 87, 88, 83, 51, 42/1 R

[56] References Cited

U.S. PATENT DOCUMENTS

| | | | |
|---|---|---|---|
| 243,250 | 6/1881 | Hall | 42/90 |
| 2,508,820 | 5/1950 | Fraley | 42/88 |
| 3,775,889 | 12/1973 | Wilburn | 42/90 |
| 4,050,175 | 9/1977 | Mulinix | 42/90 |

OTHER PUBLICATIONS

"Load-N-Cap Speed Loader"; *The American Rifleman;* vol. 124, No. 11; p. 42, Nov. 1976.

*Primary Examiner*—Charles T. Jordan

*Attorney, Agent, or Firm*—Wells, St. John & Roberts

[57] ABSTRACT

A muzzle charge storage and loading accessory is described for use in storing a single muzzle charge of powder, ball and percussion cap and for facilitating the rapid loading of the single charge into the muzzle loading fire arm. The accessory has compartments designed to separately receive the powder, ball and percussion cap. The accessory has a cylindrical housing section for housing the powder and ball compartments and a slip section for housing the percussion cap and for conveniently attaching the accessory to a shirt pocket or belt. The accessory can be used to place the percussion can directly on the percussion nipple without the sportsman having to handle the percussion cap in his fingers.

5 Claims, 5 Drawing Figures

MUZZLE CHARGE STORAGE AND LOADING ACCESSORY FOR MUZZLE LOADING FIRE ARMS

BACKGROUND OF THE INVENTION

This invention relates to muzzle loading fire arms and more particularly accessories for storing a muzzle charge and facilitating the loading of the muzzle charge into a muzzle loading fire arm.

The time required to load the powder, the ball, and the primer percussion cap into a muzzle loading gun is generally quite time-consuming. First a preselected amount of powder is placed within the barrel and then a round ball enclosed in a lubricated patch is inserted into the barrel and compressed against the powder at the base of the barrel. Alternatively, a special type of ball or bullet such as a self-expanding or self-grooving bullet, may be utilized which eliminates the need for the patch.

Next a percussion cap is placed on the primer nipple to ready the gun for shotting. Generally the time required to load a muzzle loading fire arm is greater than thirty seconds even if done by a professional.

One of the principal objects of this invention is to provide a muzzle loading accessory for storing a muzzle charge and for facilitating the loading of the charge into a muzzle loading fire arm so that the fire arm can be refired in less than 30 seconds.

An additional object of this invention is to provide a muzzle charge storage and loading accessory that may be easily carried by the sportsman without interfering with normal activities.

A further object of this invention is to provide a muzzle charge storage and loading accessory that is quite economical to manufacture and sell within the price range acceptable to a large number of muzzle loading fire arm owners.

These and other objects and advantages of this invention will become apparent upon reading the following detailed description of a preferred embodiment.

BRIEF DESCRIPTION OF THE DRAWINGS

A preferred embodiment of this invention is illustrated in the accompanying drawing, in which.

DETAILED DESCRIPTION OF A PREFERRED EMBODIMENT

Figure 1:
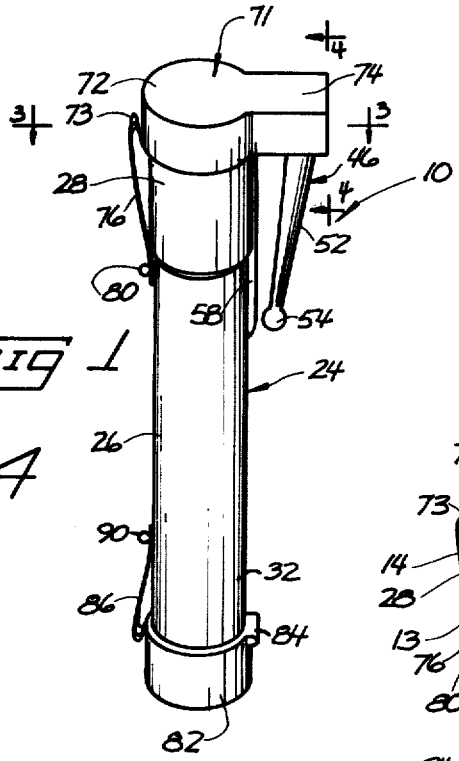
FIG. 1 is an isometric view of a muzzle charge storage and loading accessory for a muzzle loading fire arm that embodies the principal features of this invention.
Figure 2:
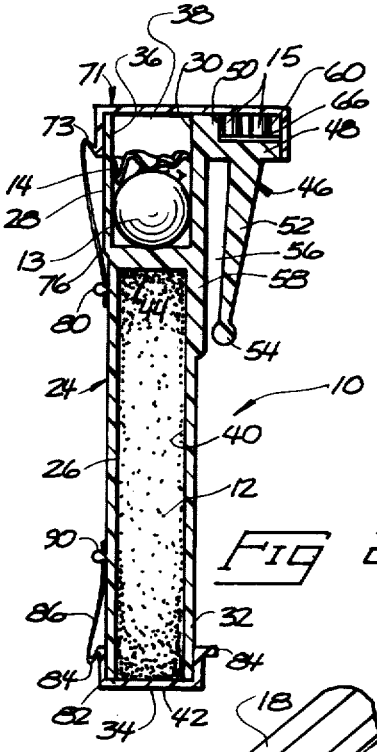
FIG. 2 is a vertical cross-sectional view of the accessory illustrated in FIG. 1 illustrating a powder compartment, a ball compartment, and a primer cap compartment.

Referring now in detail to the drawing, there is illustrated in FIG. 1 a muzzle charge storage and loading accessory 10 for storing and for facilitating the handling and loading of gunpowder 12, a ball 13 and a primer percussion cap 15 (FIG. 2). If a round ball 13 is utilized frequently a prelubricated patch 14 will be necessary. The accessory is also designed to handle a ball 13 in the form of a selfexpanding or self-grooving bullet.

Figure 5:
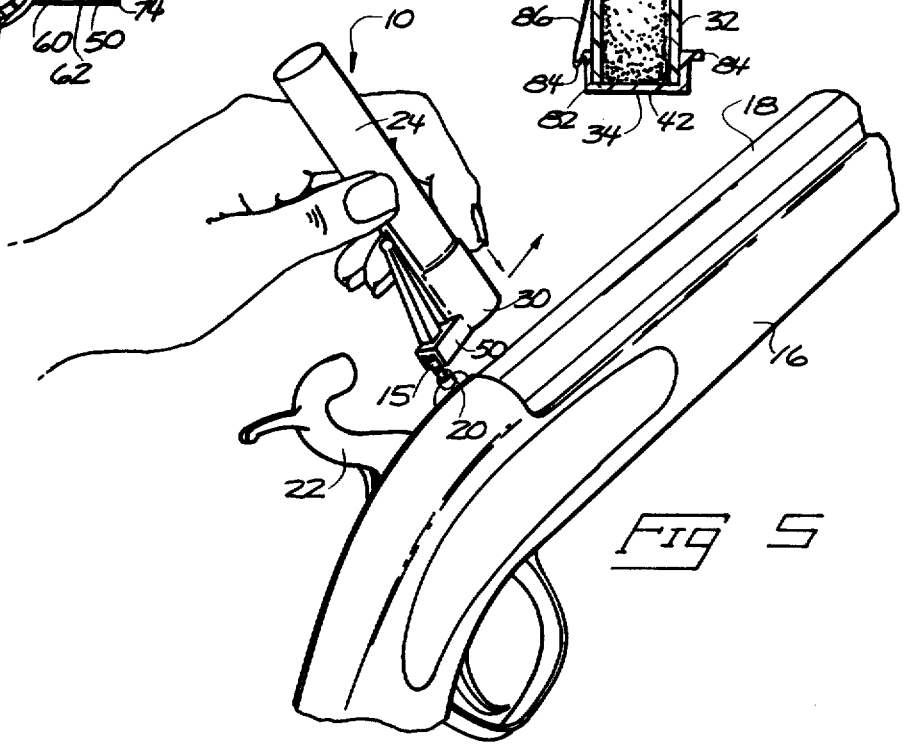
FIG. 5 is an isometric view illustrating how the accessory may be utilized in loading a primer cap on the primer nipple without the sportsman handling the primer cap.

The accessory 10 is designed for use with a muzzle loading fire arm 16 (either or rifle or a pistol) to assist the sportsman in loading the fire arm with a muzzle charge. The fire arm 16 is illustrated in FIG. 5 showing a portion of a barrel 18 and a primer nipple 20 for receiving the primer cap 15. A hammer assembly 22 is illustrated for detonating the primer cap 15.

The accessory 10 includes a general housing 24 that has a general cylindrical section 26 that extends from an upper portion 28 to a lower portion 32. The upper portion 28 terminates in an upper end 30 and the lower portion 32 terminates in a lower end 34 (FIG. 2). The upper portion 28 includes a ball cavity or compartment 36 having a circular opening 38 at the upper end 30 for receiving and storing the ball 13, or a ball 13 and a patch 14.

The lower portion 32 includes an axially directed powder cavity or compartment 40 for storing a preselected amount of gun powder 12. Cavity 40 has a circular opening 42 at the lower end 34. The two cavities 36 and 40 are separated by a partition 44.

The housing 24 additionally includes a clip section 46 that is formed integrally with the cylindrical section 26 for enabling the housing to be conveniently attached to a belt or pocket or like support to enable one or more of the accessories to be conveniently carried without interrupting the normal functions of the fire arm.

The clip section 46 includes an arm means 48 that projects outward and downward from the upper portion 28. The arm means 48 includes a radial shoulder 50 that extends radially outward from the upper portion 28. The arm means 48 further includes a depending limb 52 that extends downwardly and slightly inwardly from the radial shoulder 50 terminating in an end ball 54. The upper portion 28 includes an outer longitudinal ridge 58 that extends downwardly along the outside of the cylindrical section 26 opposing the limb 52 terminating slightly below the ball 54. A slot 56 is then formed between the depending limb 52 and the ridge 58 for receiving a belt or pocket or the like therein.

Figure 4:
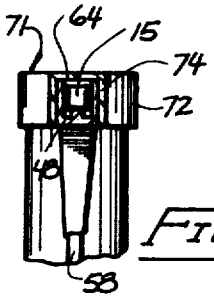
FIG. 4 is a vertical cross-sectional view taken along line 4—4 in FIG. 1.
Figure 3:
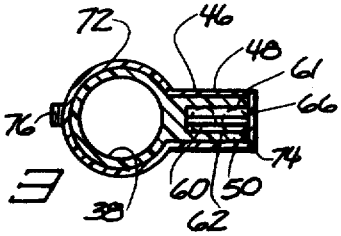
FIG. 3 is a horizontal cross-sectional view taken along line 3—3 in FIG. 1.

In a preferred embodiment, the clip section 46 contains a primer cap cavity 60 for receiving and housing at least one primer cap 15 and preferably at least two. The cap cavity 60 is formed in the radial shoulder 50 having side walls 61 and 62 that are sufficiently spaced to grip a primer cap when a primer cap is inserted into the cavity so that the primer cap 15 will not fall from the cavity 60 should the accessory be inverted. The primer cap cavity 60 has a top opening 64 (FIG. 4) and a side opening 66 (FIG. 3). The top opening provides access for initially inserting or loading the primer caps 15 into the cap cavity 60 between the walls 61 and 62. Additionally when the accessory 10 is inverted as illustrated in FIG. 5 the top opening 64 enables the sportsman to position a primer cap 15 that is contained within the cavity 60 directly onto the primer nipple 20 without actually handling the primer cap with his fingers. Once the primer cap is positioned on the primer nipple 20 the sportsman then moves the accessory 10 laterally as illustrated in FIG. 5 causing the primer cap to slide from the cap cavity through the side opening 66. Consequently the accessory 10 greatly increases the ability of the sportsman to accurately place the primer cap 15 on the primer nipple 20 without dropping the primer cap or having to fumble with the primer cap between the users fingers particularly in cold weather. Such a feature greatly decreases the time required in which to reload the fire arm 16.

The accessory 10 further includes enclosure means for selectively enclosing the ball cavity 36, the powder cavity 40 and the primer cap cavity 60. In a preferred embodiment enclosure means, includes an upper end lid or cap 71 that encloses the ball cavity 36 and the cap cavity 60 as illustrated in the drawings 1–4. The upper end lid or cap 71 includes a circular section 72 that covers the opening 38 of the ball cavity 36. The lid 71 additionally includes a radial portion 74 that extends outwardly from the circular section 72 overlying the radial shoulder 50 and enclosing the cap cavity 60 including the top opening 64 and the side opening 66. The upper end lid 71 further includes a flexible retainer strap 76 with an intergral hinge 73 that extends downwardly having a hole in an end thereof for inserting over an enlarged knob 80 so that the cap 71 is held to the housing even after the cap 71 is removed from the cap cavity 60 and the ball cavity 36. Additionally the strap 76 and the cap 71 may be rotated about the knob 80 to store the cap 71 away from the opening 38 when the cavity 36 is being emptied.

Enclosing means further includes a lower lid or cap 82 that selectively encloses the powder cavity 40. The lower lid or cap 82 has a lip 84 that enables the sportsman to easily flip the lid 82 off the lower end 34 and pour the preselected amount of powder from the cavity 40 into the fire arm barrel. The lower lid or cap 82 includes a flexible strap 86 that extends to an outer end having a hole formed therein that is inserted over a knob 90. The knob 90 extends outward from the lower portion 32 to secure the lid 82 to the housing. the knob 90 enables the strap 86 to rotate about the knob 90 to store the lid 82 along side the section 26. Strap 86 has hinge 87 similar to hinge 73.

The sportsman would generally load the accessory 10 with a muzzle charge at a convenient location prior to going to hunt or to fire the muzzle loading fire arm 16. Frequently the sportsman would load several accessories 10 depending upon the number of rounds that the sportsman intended to fire. The sportsman would place the accessories in his pocket or over a belt with the clip section 46 securing the accessory 10 securely to the belt or pocket.

When the sportsman desired to load the muzzle loading fire arm 16, he would remove the accessory 10 from the pocket or belt and flip the lower lid or cap 82 from the lower end 34 and pour the powder 12 from the powder cavity 40 into the gun barrel. He then would flip the upper lid or cap 71 from the upper end 28 to expose both the ball cavity 36 and the cap cavity 60. The sportsman then would place the ball 13 and patch 14 in the barrel and push the ball downwardly to compact the powder. The sportsman then would invert the accessory 10 holding the accessory similar to the way a person would hold a writing pen with the top opening 64 being directed to the primer nipple 20. He then would insert one of the primer caps 15 contained in the cap cavity 60 directly over the primer nipple 20 in a downward motion and then move the accessory 10 laterally to slide the inserted primer cap 15 through the side opening 66 from the cap cavity 60.

It appears that even a novice can reload a muzzle loading fire arm 16 in less than 30 seconds utilizing the accessory 10.

It should be understood that the above described embodiment is simply illustrative to the principles of this invention and numerous other embodiments may be readily devised by those skilled in the art without deviating therefrom. Therefore, only the following claims are intended to define this invention.

What is claimed is:

1. A muzzle charge storage and loading accessory for storing and facilitating the loading of a preselected charge of gunpowder, ball and percussion cap into a muzzle loading fire arm comprising:

a housing having (1) an elongated cylindrical section with an upper portion and a lower portion, and (2) a clip section formed integrally with the upper section and having an arm means extending outward and downward alongside the upper portion forming a slot therebetween to receive a belt or pocket or the like therein to enable the housing to be easily attached and removed from the belt or pocket or the like;

wherein the lower portion of the cylindrical section includes an axially extending powder cavity formed therein having an opening at a lower end of the cylindrical section for receiving a preselected amount of gunpowder;

wherein the upper portion of the cylindrical section includes an axially extending ball cavity formed therein having an opening at an upper end of the cylindrical section for receiving a ball;

wherein said housing includes a percussion cap cavity formed therein for receiving at least one percussion cap; and enclosure means for selectively enclosing the powder cavity, the ball cavity, and the cap cavity to protect the powder, ball and percussion cap from contamination during storage.

2. The muzzle charge storage and loading accessory as defined in claim 1 wherein the cap cavity is formed in the arm means that extends from the upper portion of the cylindrical section.

3. The muzzle charge storge and loading accessory as defined in claim 2 wherein the cap cavity is defined by side walls that frictionally engage a cap to hold a cap firmly in the cap cavity; in which the cap cavity has (1) a top opening to facilitate the insertion of the percussion cap onto a primer nipple of the muzzle loading gun while the percussion cap is being held firmly between the side walls and (2) a side opening to enable the cap to be slid between the walls and removed through the side opening as the accessory is moved laterally with respect to the primer nipple.

4. The muzzle charge storage and loading accessory as defined in claim 2 wherein the enclosure means includes an upper end lid that fits over and encloses both the ball cavity and cap cavity.

5. The muzzle charge storage and loading accessory as defined in claim 4 wherein the removable upper end lid includes a circular central section for enclosing the ball cavity and a radial projecting section for enclosing the cap cavity.

* * * * *